US005478080A

United States Patent [19]

Johnston

[11] Patent Number: 5,478,080

[45] Date of Patent: Dec. 26, 1995

[54] GOLF SWING PRACTICE/TRAINING DEVICE

[76] Inventor: Chris Johnston, 29 Monroe Pl., Unit B, Staten Island, N.Y. 10314

[21] Appl. No.: 346,400

[22] Filed: Nov. 29, 1994

Related U.S. Application Data

[62] Division of Ser. No. 216,299, Mar. 23, 1994, Pat. No. 5,375,843.

[51] Int. Cl.[6] ..... A63B 69/36

[52] U.S. Cl. ..... 273/187.2; 472/56

[58] Field of Search ..... 273/187.2, 189 R; 446/184, 193, 188, 192, 213, 397, 404; 472/53, 56

[56] References Cited

U.S. PATENT DOCUMENTS

| | | | |
|---|---|---|---|
| 3,283,758 | 11/1966 | Killebrew | 446/397 X |
| 3,774,572 | 11/1973 | Borraccio | 446/213 X |
| 4,743,028 | 5/1988 | Harrison | 273/187.2 |
| 5,375,843 | 12/1994 | Johnston | 273/187.2 |

FOREIGN PATENT DOCUMENTS

| | | | |
|---|---|---|---|
| 714472 | 8/1954 | United Kingdom | 446/184 |

*Primary Examiner*—George J. Marlo
*Attorney, Agent, or Firm*—Arthur W. Fisher, III

[57] ABSTRACT

A golf swing practice/training device configured to generate a signal when the power arm of a golfer is properly moved from the top of the backswing to the slot position in the downswing comprising an attachment element to mount the golf swing practice/training device to the upper portion of the power arm of the golfer having a signal generator affixed thereto wherein the signal generator is disposed adjacent the inside of the upper portion of the golfer's power arm to engage the side of the golfer's upper body to activate the signal generator when the golfer's power arm is properly positioned relative to the golfer's body during the downswing. The attachment element is an arm encircling ring of two coextensive elastic strips cooperatively forming a pocket therebetween, in which pocket is located a compressible element capable of generating an audible sound when compressed by a golfer's power arm engaging the side of the golfer's upper body.

4 Claims, 1 Drawing Sheet

GOLF SWING PRACTICE/TRAINING DEVICE

CROSS REFERENCE

This a divisional application for allowed application Ser. No. 08/216,299, filed Mar. 23, 1994, now U.S. Pat. No. 5,375,843.

BACKGROUND OF THE INVENTION

1. Field of the Invention

A golf swing practice/training device configured to generate a signal when the power arm of a golfer is properly moved from the top of the backswing to the slot position in the downswing.

2. Description of the Prior Art

The correct positioning of the power arm relative to the body of a golfer during a golf swing is an important aspect of the golf swing. The power arm is the right arm of a golfer playing with right handed clubs and the left arm of a golfer playing with left handed clubs. Typically the upper portion of the power arm is moved away from the body during the backswing. If the power arm is not properly repositioned during the downswing, power and control of the golf club head is lost. Thus, golfers must make a conscious effort to return or reposition the upper portion of the power arm against the body at the correct moment during the downswing.

In other words, during a golfer's swing, it is important to recognize when to move the elbow of the power arm into the side of the body to achieve the slot position in the downswing. If the golfer achieves the slot position, the club follows the correct inside-out path promoting straighter shots and retains the proper wrist and elbow angle promoting more power through the hitting zone.

U.S. Pat. No. 4,743,028 describes a training device for golfers including a main body having a concave side which can be held against the inside of a golfer's power arm by an arm encircling strap. The main body includes two parts biased away from each other and a spring biased switch. When the golfer's power arm is pressed against the golfer's body, the two parts of the housing are compressed and the switch is actuated, so that an indicator such as a buzzer in an electrical circuit can be controlled to indicate when the power arm is away from the golfer's body.

U.S. Pat. No. 4,058,852 shows a shirt type garment including means for insuring the upper arm of the wearer is maintained in intimate contact with the upper side chest. When the intimate contact between the power arm and chest or body is broken a resistive force is experienced and a tearing sound is generated to provide a physical and audible warning that the contact is broken, whereupon the wearer of the garment can take the necessary steps to restore the contact.

U.S. Pat. No. 2,809,042 and U.S. Pat. No. 3,419,276 teach similar bent arm devices connected across the elbow allowing the elbow to bend. An audible sounding device announces to the golfer that the elbow has bent.

U.S. Pat. No. 4,076,587, U.S. Pat. No. 5,024,443, U.S. Pat. No. 5,076,587 and Great Britain 2,129,692 are additional examples of the prior art.

SUMMARY OF THE INVENTION

The present invention relates to a golf swing practice/training device configured to generate a signal when the power arm of a golfer is properly moved from the top of the backswing to the slot position in the downswing.

The golf swing practice/training device comprises an attachment element or strap to mount the golf swing practice/training device to the upper portion of the power arm of the golfer. A signal generator such as a compressible bulb capable of generating an audible sound when compressed is attached to the attachment element or strap such that the signal generator is disposed adjacent the inside of the upper portion of the golfer's power arm.

To use, the golf swing practice/training device is positioned on the power arm approximately several inches above the elbow with the signal generator positioned on the inside of the power arm. The power arm is then bent until the forearm and bicep form an approximately 90° angle. The hand of the power arm should then be rotated so the palm is parallel to the target line with the elbow pointing to the corresponding hip. The power arm should be moved away from the side of the body and then back into the power side. At this point, the signal generator should generate an audible signal. If not, the golf swing practice/training device should be repositioned until the audible sound is generated when the power arm engages the side of the golfer's body. So positioned, the golfer is ready to practice his/her swing.

When swinging, the golfer should focus on moving his/her power elbow into the side on the downswing such that the side of the golfer's body will engage and activate the signal generator when the golfer's power arm is properly positioned relative to the golfer's body during the downswing. When the audible signal is heard, the wrist and elbow should be released in a fluid motion.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

It is generally recognized that movement from the top of the backswing to the "slot position" in the downswing is one of the most difficult moves or strokes to accomplish in golf. One reason is that during the swing it is very difficult to "feel" the elbow of the power arm move into contact with the side of the body. As defined by the Professional Golf Association of America teaching manual the slot position is "The position the hands and arms "drop into" just after the body's forward motion begins".

As described hereinafter, the golfer will not only feel, but hear when elbow of the power arm moves into contact with the side of the body. There is no mistaking that the swing is performed correctly. Instead of attempting to "hit at the ball" from the top of the backswing that commonly causes the club to be swung on outside in path, the golfer is more concerned with moving the club head into the proper position.

If the golfer achieves the proper "slot" position, the club has followed the correct inside-out path promoting straighter shots. In addition, the proper wrist and elbow angle is maintained promoting more power through the hitting zone. If the wrist and elbow release (unhinge) early, the arm and club move away from the body promoting and "outside-in" swing path which, in turn, will cause such problems as: pull-slices, pull-hooks, straight-pulls, shanks and in extreme cases, shots will be hit off the toe end of the club which will send the ball "straight right". Along with this, the club will have lost much of its speed by the time the club head reaches the ball, reducing power.

Figure 1:
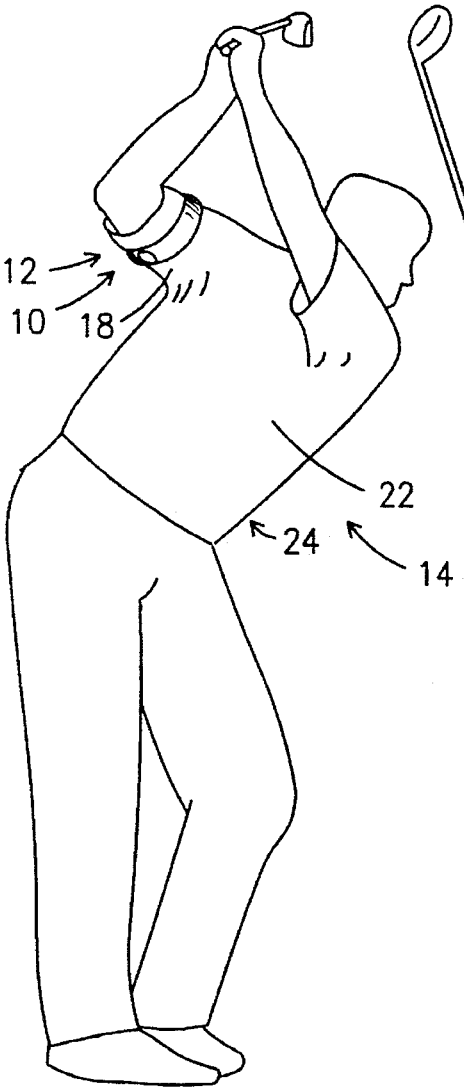
FIG. 1 is a front view of a golfer in the backswing position with the upper portion of the power arm positioned away from the golfer's body.
Figure 2:
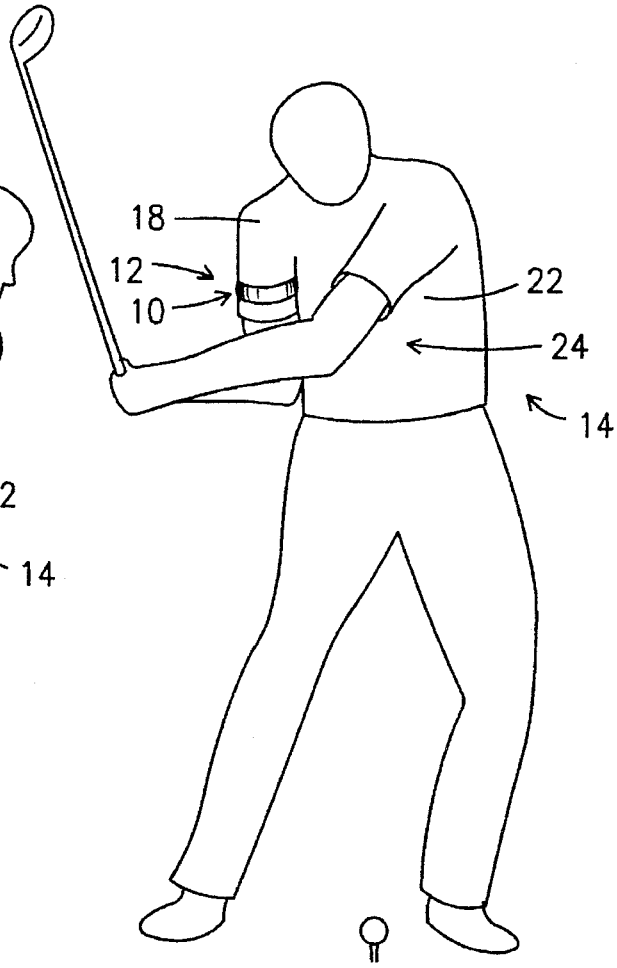
FIG. 2 is a front view of the golfer in the slot position with the upper portion of the power arm in contact with the golfer's body.

As shown in FIGS. 1 through 4, the present invention relates to a golf swing practice/training device generally indicated as 10 configured to generate a signal when the power arm generally indicated as 12 of a golfer generally indicated as 14 is properly moved from the top of the backswing as shown in FIG. 1 to the slot position during the downswing as shown in FIG. 2.

Figure 4:
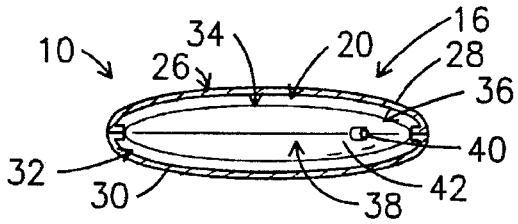
FIG. 4 is a partial cross-sectional view of the golf swing practice/training device of the present invention taken along line 4—4 of FIG. 3.
Figure 3:
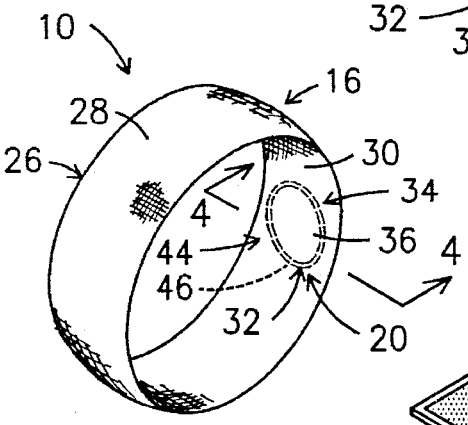
FIG. 3 is an isometric view of the golf swing practice/training device of the present invention.

As best shown in FIGS. 3 and 4, the golf swing practice/training device 10 comprises an attachment element generally indicated as 16 to affix the golf swing practice/training device 10 to the upper portion 18 of the power arm 12 of the golfer 14 having a signal generator generally indicated as 20 affixed thereto such that the signal generator 20 is disposed adjacent the inside of the upper portion 18 of the golfer's power arm 12 wherein the side of the golfer's upper body 22 will activate the signal generator 20 when the golfer's power arm 12 is properly positioned relative to the golfer's body generally indicated as 24 during the downswing as shown in FIG. 2.

As best shown in FIGS. 3 and 4, the attachment element 16 comprises a ring-like member or strap generally indicated as 26 formed of a first and second elastic strip or membrane generally indicated as 28 and 30 respectively cooperatively forming a space or pocket generally indicated as 32 formed therebetween to receive the signal generator 20 therein.

As best shown in FIGS. 3 and 4, the signal generator 20 comprises a compressible element generally indicated as 34 capable of generating an audible sound when compressed as described more fully hereinafter. The compressible element 34 may comprise an oblong bulbous member 36 having an interior cavity 38 formed therein and an aperture 40 formed through the wall 42 thereof to selectively permit air to pass into and out of the interior cavity 38. The area immediately adjacent the compressible element 34 generally indicated as 44 may be stitched as at 46 to form a securing means to limit movement of the signal generator 20 relative to the ring-like member or strap 26.

Figure 5:
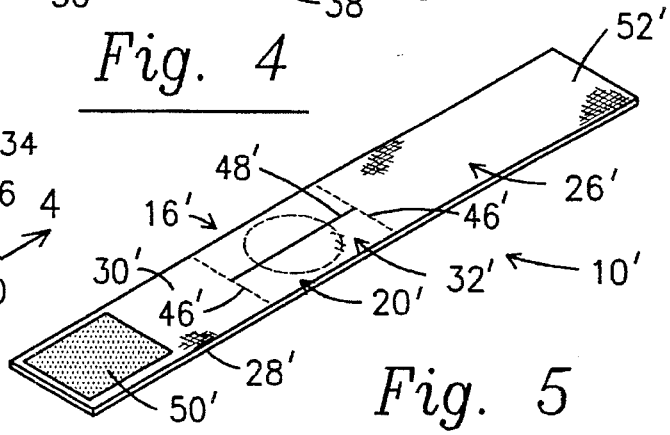
FIG. 5 is an isometric view of an alternate embodiment of the golf swing practice/training device of the present invention.

FIG. 5 shows an alternate embodiment of the golf swing practice/training device 10'. Specifically, the attachment element 16' comprises a member or strap generally indicated as 26' formed of a first and second strip or membrane indicated as 28' and 30' respectively, cooperatively forming a space or pocket 32' formed therebetween to receive the signal generator 20' therein with stitches 46' on opposite sides thereof. A slit 48' is formed through the first strip or membrane 28' to permit access to the space or pocket 32' for placement of the signal generator 20'. The attachment element 16' further includes a fastening means to secure the member or strap 26' to the golfer 14. The fastening means comprises a first and second fastening element indicated as 50' and 52' respectively such as a hook and loop combination or snap and bead combination formed on opposite ends of the strap 26' to cooperatively engage each other to secure the golf swing practice/training device 10' to the golfer's power arm 12.

To use, the golf swing practice/training device 10/10' is positioned on the power arm 12 several inches above the elbow with the signal generator 20 positioned on the inside of the power arm 12. The power arm 12 is then bent until the forearm and bicep form an approximately 90° angle. The hand of the power arm 12 should then be rotated so the palm is parallel to the target line with the elbow pointing to the corresponding hip. The power arm 12 should be moved away from the side of the body 14 and then back into the power side. At this point, the signal generator 20 should generate an audible signal. If not, the golf swing practice/training device 10/10' should be repositioned until the audible sound is generated when the power arm 12 engages the side of the golfer's body 24. So positioned, the golfer 14 is ready to practice his/her swing.

When swinging, the golfer 14 should focus on moving the elbow of his/her power arm 12 into the side of his/her body 24 on the downswing such that the side of the golfer's body 14 will engage and activate the signal generator 20 when the golfer's power arm 12 is properly positioned relative to the golfer's body 24 during the downswing. When the audible signal is heard, the wrist and elbow should be released in a fluid motion.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A golf swing practice/training device configured to generate a signal when the power arm of a golfer is properly moved from the top of the backswing to the slot position in the downswing comprising an attachment element to mount the golf swing practice/training device to the upper portion of the power arm of the golfer and having a signal generator affixed thereto wherein said signal generator is disposed adjacent the inside of the upper portion of the golfer's power arm to engage the side of the golfer's upper body to activate said signal generator when the golfer's power arm is properly positioned relative to the golfer's body during the downswing, said attachment element comprises a flat strap formed of a first and second strip cooperatively forming a pocket therebetween to receive said signal generator therein, said attachment element includes a fastening means to secure said flat strap to the golfer, said fastening means comprises a first and second fastening element formed on opposite ends of said flat strap to selectively engage each other to secure said golf swing practice/training device to the golfer's power arm, said signal generator comprises a compressible element capable of generating an audible sound when compressed between the inside of the upper portion of the golfer's power arm and the side of the golfer's upper body.

2. The golf swing practice/training device of claim 1 wherein said compressible element comprises an oblong bulbous member including an interior cavity formed therein and an aperture formed through the wall thereof to selectively permit air to pass into and out of said interior cavity.

3. The golf swing practice/training device of claim 2 wherein the area immediately adjacent said compressible element is stitched to limit movement of said signal generator relative to said flat strap.

4. The golf swing practice/training device of claim 1 wherein a slit is formed through said first strip to permit access to said pocket for placement of said signal generator therein.

* * * * *